US008152128B2

(12) United States Patent
Asplund et al.

(10) Patent No.: US 8,152,128 B2
(45) Date of Patent: Apr. 10, 2012

(54) PUMP MOUNT BASE

(75) Inventors: Richard Asplund, Simi Valley, CA (US); David Varnon, Canyon Country, CA (US)

(73) Assignee: Zodiac Pool Systems, Inc., Vista, CA (US)

( * ) Notice: Subject to any disclaimer, the term of this patent is extended or adjusted under 35 U.S.C. 154(b) by 221 days.

(21) Appl. No.: 12/508,425

(22) Filed: Jul. 23, 2009

(65) Prior Publication Data

US 2010/0019121 A1 Jan. 28, 2010

Related U.S. Application Data

(60) Provisional application No. 61/083,376, filed on Jul. 24, 2008.

(51) Int. Cl.
*F16M 1/00* (2006.01)

(52) U.S. Cl. ..... 248/678; 248/671; 248/346.01

(58) Field of Classification Search ..... 248/678, 248/671, 672, 346.01
See application file for complete search history.

(56) References Cited

U.S. PATENT DOCUMENTS

| | | | | |
|---|---|---|---|---|
| 2,064,751 | A * | 12/1936 | Hussman | 248/544 |
| 2,538,228 | A * | 1/1951 | Blair | 248/639 |
| 3,493,201 | A * | 2/1970 | Marran | 248/678 |
| 4,138,079 | A * | 2/1979 | Ehret et al. | 248/558 |
| 4,461,447 | A * | 7/1984 | Gottlob | 248/678 |
| 4,809,421 | A * | 3/1989 | Justice | 29/525.02 |
| 6,325,352 | B1 * | 12/2001 | Story | 248/678 |

OTHER PUBLICATIONS

Author Unknown, Hayward Pool Products website search results for "spx3200wf" including TriStar™ Replacement Parts and Owner's Manuals, available at: http://www.haywardnet.com/search/searchResults.cfm, available at least as early as Jul. 23, 2009, 2 pages.
Author Unknown, Hayward Pool Products Catalog: TriStar™ SP3200 Pump Series Replacement Parts, available at least as early as Jul. 23, 2009, p. 71, pp. 110-113.
Author Unknown, Haywood Pool Products, TriStar™ Pump Series Replacement Parts Listing available at: www.haywardpool.com, available at least as early as Jul. 23, 2009, pp. 11-12.
Author Unknown, Haywood Pool Products, TriStar™ Pump Series Replacement Parts Listing, available at: www.haywardcanada.com, available at least as early as Jul. 23, 2009, pp. 7-8.
Author Unknown, Jandy 2007 Pool and Spa Products Catalog, "Pumps," p. 11.
Author Unknown, Jandy 2007 Pool and Spa Products Catalog, "Pump Parts," pp. 15-16.

(Continued)

*Primary Examiner* — Anita M King
(74) *Attorney, Agent, or Firm* — Dorsey & Whitney LLP

(57) ABSTRACT

A pump mount base for a filter/pump assembly in a pool or spa fluid handling system allows a user to adjust the height of the filter/pump assembly and thus its fluid inlets and fluid outlets. This adjustability allows the user to choose from a variety of replacement assemblies rather than being forced to select the same filter/pump assembly previously or originally used in the system. The height of the filter/pump assembly may be further altered by the engagement of shims, which may be positioned by pins in the bottom surface of the shim that engage corresponding apertures formed in an upper support surface of the pump mount base. The shims may be formed integrally with the pump mount base in the molding process by which the base is formed, and/or the shims may be provided separately.

20 Claims, 5 Drawing Sheets

OTHER PUBLICATIONS

Author Unknown, Jandy 2008 Pool and Spa Products Catalog, "Pumps," p. 11.
Author Unknown, Jandy 2008 Pool and Spa Products Catalog, "Pump Parts," p. 17.
Photograph 1—Photograph of Hayward Pool Products TriStar™ Pump Series Base, Part No. 3200wf, available at least as early as Jul. 23, 2009.
Photograph 2—Photograph of Hayward Pool Products TriStar™ Pump Series Base, Part No. 3200wf, available at least as early as Jul. 23, 2009.
Photograph 3—Photograph of Hayward Pool Products TriStar™ Pump Series Base, Part No. 3200wf, available at least as early as Jul. 23, 2009.
Photograph 4—Photograph of Hayward Pool Products TriStar™ Pump Series Base, Part No. 3200wf, available at least as early as Jul. 23, 2009.
Photograph 5—Photograph of Hayward Pool Products TriStar™ Pump Series Base, Part No. 3200wf, available at least as early as Jul. 23, 2009.
Canadian Office Action dated Nov. 21, 2011, CA 2,674,107, 2 pages.

* cited by examiner

PUMP MOUNT BASE

CROSS-REFERENCE TO RELATED APPLICATIONS

This application claims the benefit of priority under 35 U.S.C. 119(e) of U.S. provisional application No. 61/083,376 entitled "Adjustable pump mounting base" filed 24 Jul. 2008, which is hereby incorporated by reference as if fully set forth herein.

TECHNICAL FIELD

This technology generally relates to pump mount devices, and more specifically to customizable pump mount devices.

BACKGROUND

Pumps are used in fluid circulation systems to manipulate the direction and speed of a fluid. For example, pools and spas may use pumps to force water through water heaters, heat exchangers, salt and chlorine generators, and pool filters. In general, a pump includes a fluid inlet for allowing fluid to enter the pump, and a fluid outlet to allow the fluid to exit the pump.

Pumps may be designed in a variety of sizes and different pumps may differ in the height at which their inlet and outlet ports are positioned. This variability in positioning of the inlet and outlet height, as well as the variety of sizes and types of fluid circulation systems, may limit the flexibility of a pool system designer in selecting a pump, thus increasing manufacturing and installation costs. For example, a pump selected based on a specific flow rate, price, or size may have inlets and/or outlets that are not ideally positioned for placement in a new or existing system. Therefore, an installer or a pool owner may be forced to select a pump based solely on the compatibility of its ports or construct customized mounting bases, connectors, and/or fluid fittings to integrate the desired pump into the existing fluid handling system.

When the inlet and outlets of a desired pump are incompatible with the existing fluid handling system, the installer or pool owner may be required to expend time and money to re-configure the system to accommodate the desired pump. Alternatively, the installer or pool owner may choose to construct a customized base for the desired pump. In the case of customized pump bases, construction requires extra time to create and install the pump into the fluid handling system. In some cases, customized pump bases may not be of the highest quality leading to fluid leakage and pipe or pump failure. These factors are important to consider when selecting a pump, as they may increase the cost, flexibility, and complexity of designing a pump system for a pool.

SUMMARY

The present disclosure is directed to is a pump mount base for supporting a pump assembly in a pool or spa fluid handling system. Mounting the pump assembly on the upper surface of the pump mount base elevates the pump assembly off the mount surface so that the height of the of inlet and outlet ports may better match the existing plumbing of the spa or pool fluid handling system. This adjustability may allow the pump to be better aligned with the existing components of the fluid handling system to which the pump is operably and fluidly attached. The height of the pump assembly inlets and outlets may be adjusted further by placing shims on the upper surface of the pump mount base. The shims may be positioned and held in place by pins which may be received into apertures formed on the base. The pump mount base may also include mounting holes to allow passage of bolts, screws, pegs, or other connecting devices through the body of the pump mount base so that the pump may be attached to the pump mount base and possibly to the ground or mount surface.

The shims may be formed integrally with the pump mount base during the molding process by which the base is formed and thus supplied with the pump mount base, or they may be supplied separately from the pump mount base. Different thickness shims may offer more fully customized pump height. Before use, the shims are disconnected from the base and utilized as needed.

When shims are molded with the pump mount base, the shims may be positioned within and attached to cavities in the pump mount base. Alternatively shims may be attached to the periphery of the pump mount base.

Further aspects of the pump mount base described herein will be realized upon review of the specification, drawings and appended claims.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various embodiments and implementations as further illustrated in the accompanying drawings and defined in the appended claims.

DETAILED DESCRIPTION

As an overview, various embodiments of a pump mount base for use with, for example, various filter/pump assemblies for pool and spa fluid circulation systems are described herein. In new installations, a filter/pump assembly would be placed on a solid mount surface and its fluid inlet and outlet connected to the fluid outlet and inlets, respectively, of the spa or pool system. If the existing filter/pump is later replaced, the new filter/pump assembly's fluid inlet and outlet may not be positioned at the same height as the previous assembly. The currently described pump mount base may be used to raise the new filter/pump assembly so that the fluid inlet and outlet align with the existing system. The current pump mount base is designed to accommodate a variety of pump types.

Various implementations of the pump mount base may be used with a filter/pump assembly for a pool or spa fluid handling system and may help raise, and therefore customize, the height of fluid inlets and outlets on the filter/pump assembly above the ground, floor, or mount surface. The pump mount base may also include a plurality of shims that may help further raise the height of the fluid inlet and outlet. The shims may be designed with extensions, or pins, that engage corresponding holes, or apertures, in the upper surface of the pump mount base.

Shims may be provided with the pump mount base or as separate components. In some cases, the shims are molded with the pump mount base when it is manufactured and thus are supplied attached to the pump mount base. The shims may be provided in a variety of thicknesses to aid in customization of the height of the filter/pump assembly. The pump mount base may also include mounting holes to aid in fixedly attaching the filter/pump assembly to the pump mount base, the solid mount surface, or both. By allowing customization of the filter/pump assembly height, pool and spa owners, operators, and service persons may have greater flexibility in choosing alternative filter/pump assemblies rather than being forced to replace a broken or aging filter/pump assembly with the identical model.

Figure 1:
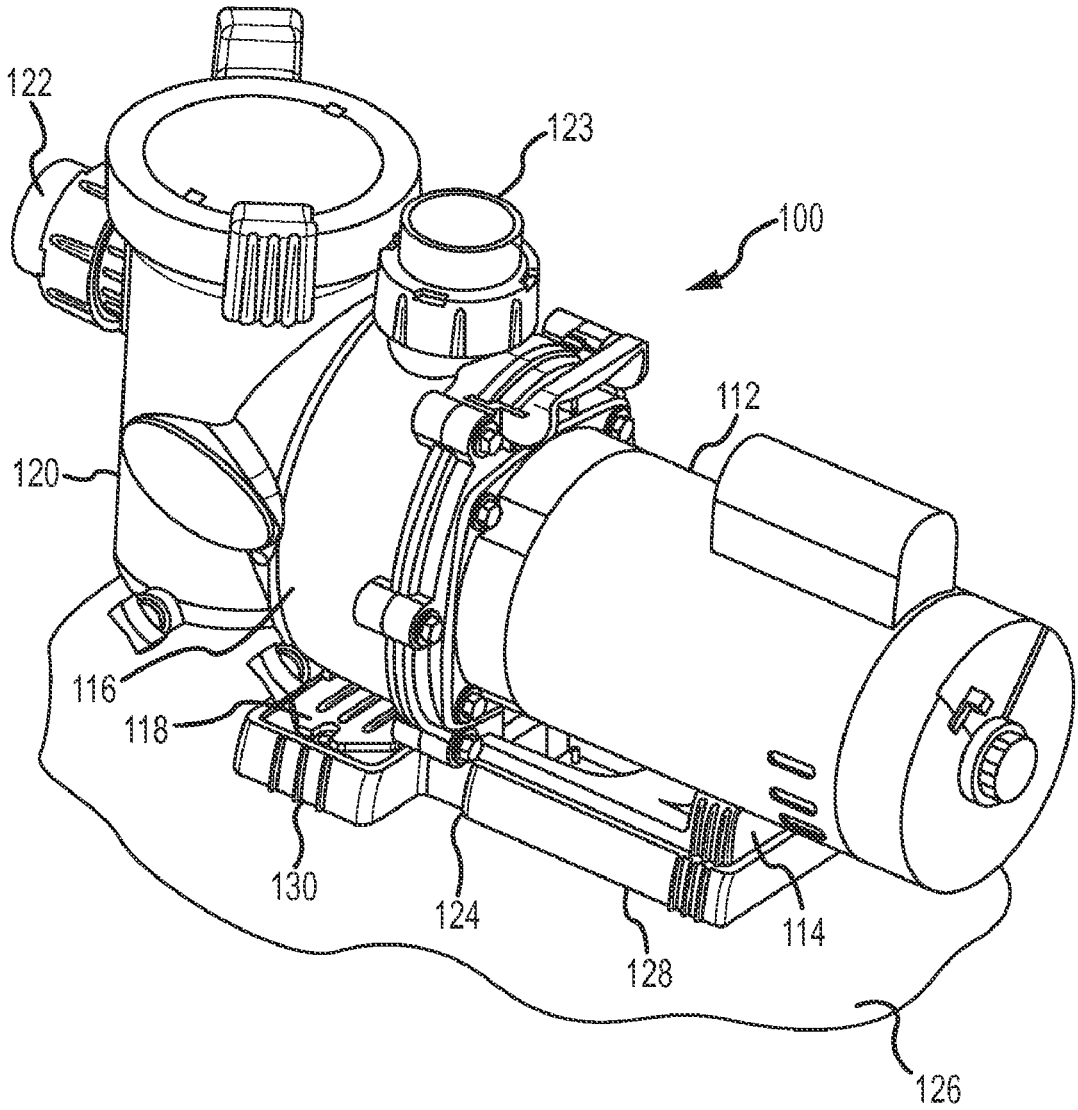
FIG. 1 illustrates a filter/pump assembly of a pool/spa fluid handling system seated on an implementation of a pump mount base.

In an example embodiment depicted in FIG. 1, the filter/pump assembly 100 includes a motor 112, a motor cradle 114, a pump housing 116, a pump housing foot 118, a debris trap receptacle 120, a fluid inlet 122, and a fluid outlet 123 in fluid communication with the fluid inlet 122. The filter/pump assembly 100 sits upon and is supported by the pump mount base 124. The pump mount base 124, in turn, may sit atop and be supported by a solid mount surface 126, such as the ground, a floor, shelf, or table.

The pump mount base 124 may have a main body, which may take the general form of a T-shape. The pump mount base 124 may further include two portions, a motor base portion 128 and a housing base portion 130. The motor base portion 128 may be positioned generally below the motor 112, and the housing base portion 130 may be positioned generally below the pump housing 116. The pump housing foot 118 may be seated atop and supported by the housing base portion 130 of the pump mount base 124. Likewise, the motor cradle may be seated atop and supported by the motor base portion 128 of the pump mount base 124. In some implementations, as shown in FIG. 1, the motor cradle 114 may be fixedly attached to the filter/pump assembly 100, for example, by at least one bolt or screw. In some alternative implementations, the motor cradle 114 may not be fixedly attached to the filter/pump assembly 100. Further implementations may not have a motor cradle.

In some implementations, the filter/pump assembly 100 may be secured to the pump mount base 124, and/or the pump mount base 124 may be secured to the mount surface 126, by a fastener, for example, a nut, bolt, screw, peg, or adhesive. In other implementations, the filter/pump assembly 100 is attached to the pump mount base 124, but the pump mount base 124 is not fixedly attached to the mount surface 126. In still further implementations, the filter/pump assembly 100 is not attached to the pump mount base 124 and the pump mount base 124 is not attached to the mount surface 126.

The pump mount base 124 may be manufactured from a variety of materials, including, plastic, resin, ceramic, metal, rubber, or wood. In some embodiments, the pump mount base 124 may be manufactured of hard, impact-resistant plastic.

Figure 2:
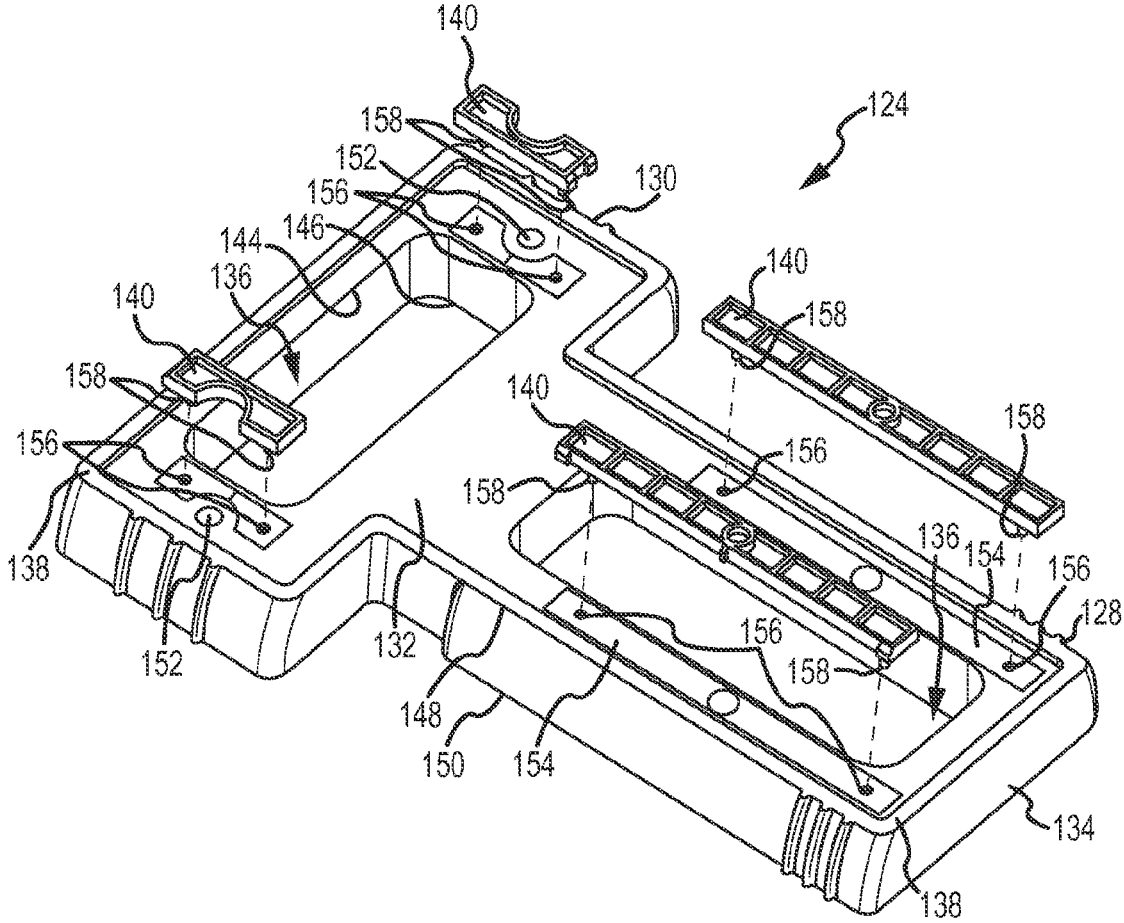
FIG. 2 illustrates an exploded view of the pump mount base with shims detached and located above their respective connection apertures.

FIG. 2 is an exploded perspective view of the pump mount base 124 without the filter/pump assembly 100. In this view a plurality of shims 140 are visible, positioned above the pump mount base 124. As described above, the pump mount base 124 may have a generally "T"-shape, with the motor base portion 128 defining the vertical body of the "T" and the housing base portion defining the horizontal portion of the "T." The pump mount base 124 may also define a major axis corresponding to the vertical body of the "T" that bisects the pump mount base 124 into two generally symmetric halves.

The pump mount base 124 may further include an upper support surface 132, a skirt 134, and a plurality of cavities 136 created within the upper support surface 132. The upper support surface 132 of the pump mount base 124 is generally planar and parallel to the mount surface 126 to provide a flat surface for supporting the filter/pump assembly 100. At the periphery of the upper support surface 132 may be a lip 138 structure. The lip 138 structure may aid in preventing the filter/pump assembly 100 from moving off the pump mount base 124. As described in more detail below, the lip 138 may also help to position and secure a plurality of shims 140 seated on the upper support surface 132 of the pump mount base 124. Other embodiments may not include a lip 138 structure. In still other embodiments, the lip 138 structure may be discontinuous.

The upper support surface 132 of the pump mount base 124 may further define a plurality of apertures 156, channels, and/or cavities 136 within the upper support surface 132 of the pump mount base 124. As shown in the present embodiment, two large, generally rectangular cavities 136 may be formed in the upper support surface 132—one cavity 136 positioned generally in the motor base portion 128 and a second cavity 136 positioned generally in the housing base portion 130. The cavities 136 may be designed for one or more of the following purposes: to lower the amount of material needed to manufacture the pump mount base 124, to increase the structural integrity of the pump mount base 124, or to provide a location for the attachment of shims 140 as described below.

The cavities 136 are generally centered within their respective portions of the pump mount base 124. The long sides of the rectangles may be parallel to the long edges of the motor base portion 128 and housing base portion 130 respectively. The cavities 136 in this embodiment may be defined by cavity walls 142. The cavity walls 142 may include a proximal wall edge 144 and a distal wall edge 146. The proximal wall edge 144 of the cavity wall 142 may be at or near the upper support surface 132 of the pump mount base 124 and the distal wall edge 146 of the cavity wall 142 may extend downward to contact the mount surface 126. Alternative embodiments may not include cavities 136, or may include only one cavity 136 positioned within the motor base portion 128 or the housing base portion 130, or the only one cavity 136 positioned in both the motor base portion 128 and the housing base portion 130. Still further embodiments may include more than two cavities 136 in the pump mount base 124.

The upper support surface 132 may also define at least one mounting hole 152 in the housing base portion 130 of the pump mount base 124. The mounting hole 152 may be in communication with the mount surface 126. The mounting hole 152 may have a generally circular cross-section designed to allow, for example, bolts, screws, or pegs to pass through the pump mount base 124. In other embodiments, the mounting hole 152 may be in the form of a channel to provide versatility in the mounting position. In various implementations, the bolts, screws, or pegs may help stabilize the pump mount base 124 and filter/pump assembly 100 or secure the pump mount base 124 to either the mount surface 126 or the filter/pump assembly 100, or both.

A skirt 134 may be formed at or near the periphery of the pump mount base 124. The skirt 134 may have a proximal edge 14.8 and a distal edge 150. The proximal edge 148 may be positioned at or near the periphery of the upper support surface 132 of the pump mount base 124. In embodiments with a lip 138, the proximal edge 148 may be positioned at or near the lip 138 of the upper support surface 132 of the pump mount base 124. The skirt 134 may extend generally downward from the proximal edge 148 to contact the mount surface 126 at the distal edge 150. The vertical distance between the proximal 148 and distal edges 150 of the skirt 134 define a skirt height. The skirt height may define a base height the filter/pump assembly 100 is raised off the mount surface 126 when there is no lip 138 structure.

The upper support surface 132 of the pump mount base 124 may further define a plurality of receptacles 154 defined by the upper support surface 132 of the pump mount base 124. In the embodiment shown in FIG. 2, the receptacles 154 include grooved channels within the upper support surface 132 of the pump mount base 124. In other embodiments, the receptacles 154 may be formed as raised patterns in the upper support surface 132 of the pump mount base 124. In other embodiments, the receptacles 154 form shallow depressions in the upper support surface 132 of the pump mount base 124 such that the plane of the receptacle 154 is lower than the plane of the upper support surface 132. In still other embodiments the receptacle 154 may be raised from the surface of the upper support surface 132 of the pump mount base 124.

A pair of receptacles 154 may be positioned on opposite sides of the major axis of the pump mount base 124. Thus, as shown in the embodiment of FIG. 2, a receptacle 154 positioned on one side of the major axis on the upper support surface 132 of the motor base portion 128 may have a corresponding receptacle 154 positioned on the upper support surface 132 of the motor base portion 128 on the opposite side of the major axis. Similarly, if there is a receptacle 154 positioned on the motor base portion 128 then there may be a corresponding receptacle 154 on the housing base portion 130. In other embodiments the receptacles 154 on the motor base portion 128 may be contiguous with the receptacle 154 on the housing base portion 130 resulting in only one receptacle 154 on either side of the major axis. In further embodiments, the receptacles 154 on either side of the major axis may be connected resulting in only one receptacle 154 on the upper support surface 132 of the pump mount base 124. In further embodiments there are no receptacles in the upper surface of the pump mount base.

As shown in the embodiment of FIG. 2, a plurality of apertures 156 may be positioned in each receptacle 154. The apertures 156 may or may not be in communication with the mount surface 126. As depicted in FIG. 2, there are two apertures 156 on either side of the cavity 136 in the motor base portion 128, and two apertures 156 on either side of the cavity 136 in the housing base portion 130. Alternative embodiments may have greater or fewer apertures 156 in each receptacle 154. Still further embodiments may lack apertures 156 or have apertures 156 but no receptacles 154. This embodiment includes a first aperture 156 in each receptacle 154 with a circular cross-section and a second aperture 156 with a hexagonal cross-section. Varying the shape of the apertures 156 may aid in the orientation and retention of shims 140 as discussed below. In other embodiments, the cross-section of the apertures 156 may be other than circular or hexagonal, for example, the apertures may be octagonal, heptagonal, pentagonal, square, triangular, oval, rectangular, or star-shaped among others.

FIG. 2 also shows a plurality of shims 140 positioned above the receptacles 154. The shims 140 are designed to raise the filter/pump assembly evenly above the upper support surface 132 of the pump mount base 124, and the shims 140 may be intended for use as a set rather than one at a time. The shims may be formed and sized to match a corresponding receptacle 154 and thus the receptacles 154 act as guides for proper placement of the shims 140.

The shims 140 may be generally rectangular shaped and may have a shape similar to the shape of the corresponding receptacle 154. The shims 140 above the receptacles 154 in the housing base portion 130 define a long edge with a semi-circular indentation that allows the shim 140 to engage the upper surface 132 of the housing base portion 130 without covering the mounting holes 152. Other embodiments include shims 140 of various sizes and shapes. In still further embodiments there may be only two shims 140—the shims 140 of the motor base portion 128 and the housing base portion 130 may be contiguous and there may be a corresponding shim 140 on the opposite side of the major axis of the pump mount base 124. In further embodiments there may be only one shim 140 covering the upper support surface 132 of the pump mount base 124, such as, where all four shims 140 of FIG. 2 are connected.

The shims 140 include an upper and lower surface and a plurality of pins 158 designed to aid in securing, positioning, and retaining the shims 140 on the upper support surface 132 of the pump mount base 124. The pins 158 are positioned on the shim 140 to correspond with the apertures 156 in the upper support surface 132 of the pump mount base 124. The pins 158 extend generally down and away from the lower surface of the shim 140. The shape of the pins 158 may be varied to aid in positioning the shims 140 on the upper support surface 132 of the pump mount base 124. In some embodiments, the pins 158 may be generally cylindrical-shaped with a circular cross-section. Other embodiments of the pins 158 may have a cross-section other than circular and be designed to fit with particular apertures 156 in the upper support surface 132 of the pump mount base 124. For example, with respect to the apertures 156 described above, a shim 140 may have a first pin 158 with a circular and a second pin 158 with a hexagonal cross section cross section to fit within the hexagonal aperture 156 so that the shim 140 may be placed in only one orientation on the upper support surface 132 of the pump mount base 124. Alternatively, the second pin 158 may also be cylindrical but placed within the hexagonal second aperture 156 to form a tight fit between the two. The pins 158 may be designed to fit tightly into the aperture 156 or the pins 158 and apertures 156 may be designed for a loose connection between the two structures.

The upper shim surface and lower shim surface are generally flat and planar. In other embodiments the shims 140 may have grooves or raised ridges that may aid in securing, positioning, or retaining the shims 140 on the upper support surface 132 of the pump mount base 124. When the shims 140 are seated on the upper support surface 132 of the pump mount base 124, the distance between the upper shim surface and lower shim surface may further define the distance that the filter/pump assembly 100 is raised above the mount surface 126.

In various embodiments the shims 140 may have apertures 156 for receiving pins 158 from a second shim 140. In these embodiments, the shims 140 may be designed to be stacked to further elevate the filter/pump assembly 100 above the pump mount base 124 upper support surface 132.

The shims 140 may be formed in the same mold as the pump mount base 124 and may be manufactured of the same material as the pump mount base 124. In other embodiments, the shims 140 may be manufactured of material that is different than the material used to manufacture the pump mount base 124. In some embodiments, the pins 158, the shims 140, and the pump mount base 124 may all be manufactured of generally different materials.

Figure 3:
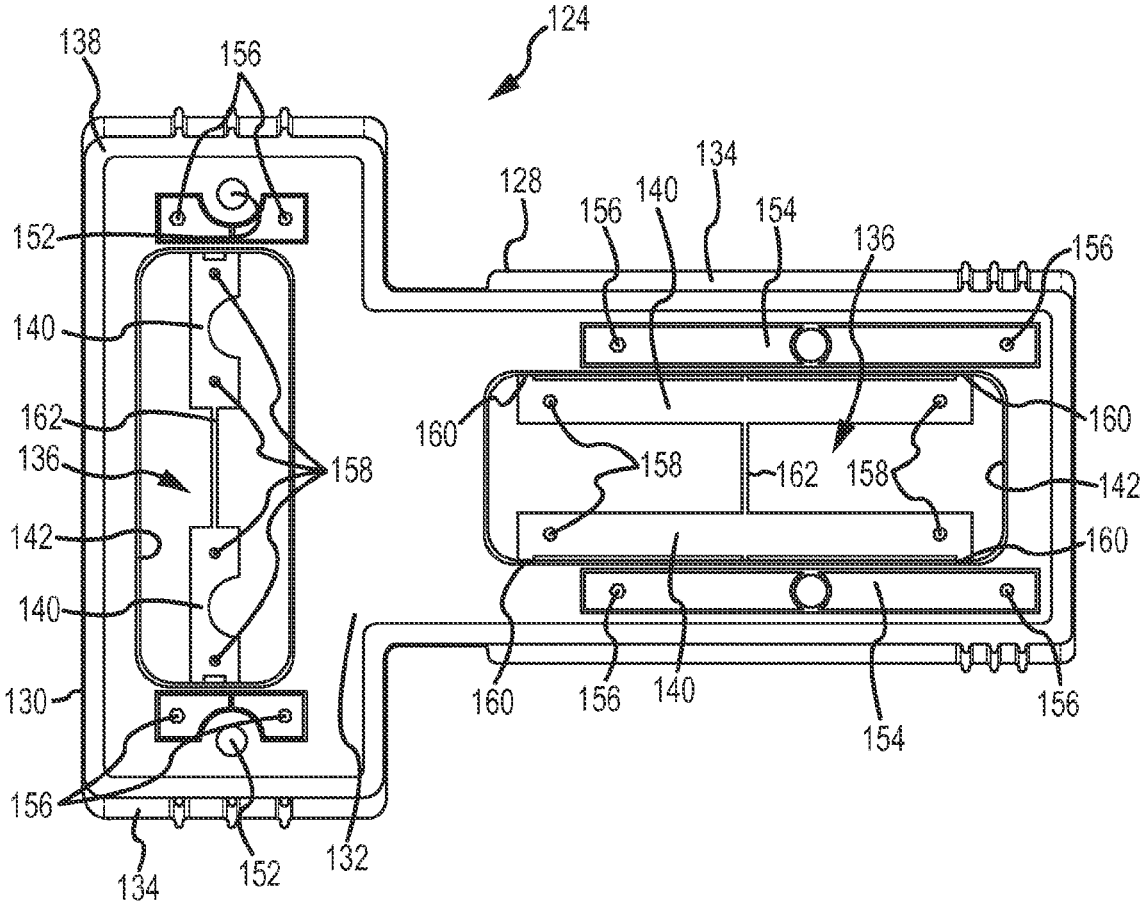
FIG. 3 illustrates a top view of the pump mount base with shims as an integrally formed component.

FIG. 3 is a top view of the pump mount base 124 as it may be manufactured. As shown here, the pump mount base 124 may be molded with the shims 140 in a single unit. The bottom surface of the shim 140 is molded facing up in this embodiment and is thus visible as are the pins 158 attached to the bottom surface. The shims 140 may be attached to the cavity walls 142 by a plurality of tabs 160. Where there is more than one shim 140 positioned within the cavity 136 as in the present embodiment, the shims 140 may also be attached to each other by a connector 162. The tabs 160 and connectors 162 may or may not be made of the same material as the shims 140, and pump mount base 124.

The shims 140 may be located within the cavity 136 of the portion to which they are designed to engage. For example, the shims 140 attached to the cavity walls 142 in the motor base portion 128 may be designed to engage the upper support surface 132 of the motor base portion 128, while the shims 140 attached to the cavity walls 142 in the housing base portion 130 may be designed to engage the upper support surface 132 of the housing base portion 130. In alternative embodiments, shims 140 attached to the motor base portion 128 may be designed to engage the upper support surface 132 of the housing base portion 130, and shims 140 attached to the housing base portion 130 may be designed to engage the motor base portion 128. In further embodiments, shims 140 may be interchangeable between the motor base portion 128 and the housing base portion 130.

Before use, the shims 140 may be disconnected from the cavity wall 142 and disconnected from each other. Disconnection may include breaking the tabs 160, the connectors 162, or both.

Figure 4:
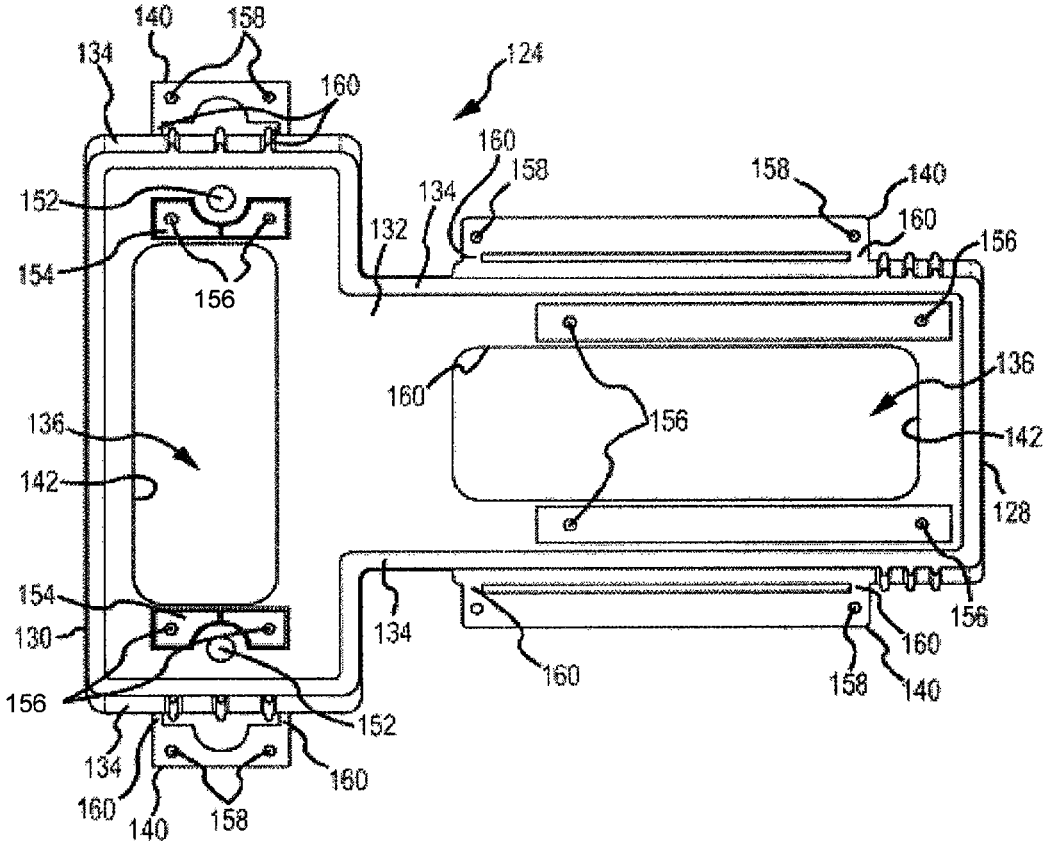
FIG. 4 illustrates an alternative embodiment of the pump mount base with shims as an integrally formed component attached to the periphery of the pump mount base.
Figure 5:
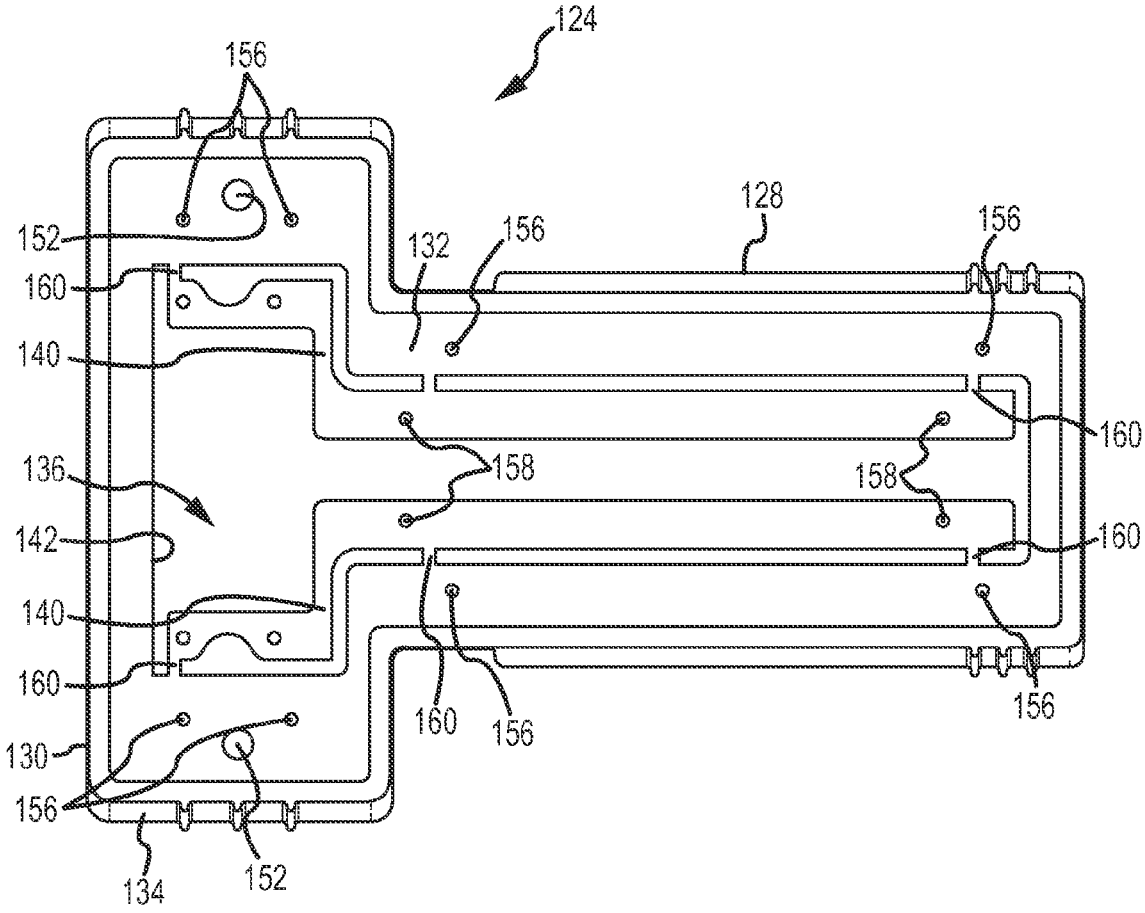
FIG. 5 illustrates another alternative embodiment of the pump mount base having only two shims mounted within a single large cavity.

FIGS. 4 and 5 depict two alternative embodiments of the presently disclosed pump mount base 124. FIG. 4 shows a pump mount base 124 with shims 140 attached to the periphery of the pump mount base 124 at the skirt 134. Alternative embodiments may have shims 140 attached to both the skirt 134 and the cavity wall 142. FIG. 5 depicts an alternative embodiment with only two shims 140. In this embodiment, one shim 140 is placed on the upper support surface 132 of the pump mount base 124 on either side of the major axis. This shim 140 contacts both the housing base portion 130 and the motor base portion 128. This embodiment also lacks receptacles 154 in the upper support surface 132 of the pump mount base 124. Further, in the embodiment depicted in FIG. 5, the shims 140 attached to the cavity wall 142 on one side of the major axis are designed to be placed on the upper support surface 132 of the pump mount base 124 on the opposite side of the major axis.

As described above, a pump mount base 124 may aid in raising a filter/pump assembly 100 of a fluid handling system above the mount surface 126 so that fluid connections may be more easily made. Shims 140 with different thicknesses may be selected so that the filter/pump assembly 100 can be raised higher than the upper support surface 132 of the pump mount base 124. Further, the shims 140 may be provided in varying thicknesses and as integral parts of the pump mount base 124 as provided, or the shims 140 may be separately supplied.

All directional references (e.g. upper, lower, upward, downward, left, right, leftward, rightward, top, bottom, above, below, inner, outer, vertical, horizontal, clockwise and counterclockwise) are only used for identification purposes to aid the reader's understanding of examples of the invention, and do not create limitations, particularly as to position, orientation, or use of the invention unless specifically set forth in the claims. Joinder references (e.g. attached, coupled, connected, joined and the like) are to be construed broadly and may include intermediate members between a connection of elements and relative movement between elements. As such, joinder references do not necessarily infer that two elements are directly connected and in a fixed relation to each other.

In some instances, components are described with reference to "ends" having a particular characteristic and/or being connected to another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set for therein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A pump mount base for raising and supporting a filter/pump assembly in a fluid handling system above a mounting surface comprising a main body defining a support surface; and one or more shims for placement atop the support surface of the main body, the shims defining an upper surface and a lower surface for contacting the upper surface of the main body; wherein each shim includes one or more pins originating and extending from the lower surface of the shim; and the upper surface of the main body further defines one or more apertures for respectively receiving the pins.

2. The pump mount base of claim 1, wherein the shims are molded with and attached to the pump mount base for detachment and placement on the support surface.

3. The pump mount base of claim 2, wherein the main body defines a cavity bordered by cavity walls extending from the support surface to the mounting surface; and the shims are removably attached to the cavity walls before placement atop the support surface.

4. The pump mount base of claim 2, wherein the main body further comprises a skirt extending from a periphery of the support surface to contact the mount surface; and the shims are removably attached to the skirt before placement atop the support surface.

5. The pump mount base of claim 1, wherein the support surface further defines one or more mounting holes for passage of a fastener.

6. The pump mount base of claim 1, wherein the shims are supplied separately.

7. The pump mount base of claim 1, wherein the support surface of the main body further defines one or more receptacles for receiving the shims.

8. The pump mount base of claim 7, wherein the receptacles are recessed into the support surface.

9. The pump mount base of claim 7, wherein the receptacles are defined by ridges extending from the support surface.

10. The pump mount base of claim 1, wherein the one or more shims define apertures on the upper surface of the shims for receiving pins from a second shim.

11. The pump mount base of claim 1, wherein the one or more shims have a first pin and a second pin;

the first pin has a circular cross section; and the second pin has non-circular cross section.

12. The pump mount base of claim 1 having at least a first shim and a second shim, wherein the main body further comprises a first portion and a second portion;

the main body defines a first cavity extending from the support surface to the mount surface within the first portion and a second cavity extending from the support surface to the mount surface within the second portion;

the first shim extends from the first portion to the second portion around the first and second cavities when positioned on the support surface; and the second shim extends from the first portion to the second portion around the first and second cavities when positioned on the support surface.

13. The pump mount base of claim 12, wherein the first shim and the second shim are connected.

14. The pump mount base of claim 12, wherein the first portion and the second portion substantially define a T-shaped structure.

15. The pump mount base of claim 12, wherein the cavity of the first portion is in communication with the cavity of the second portion.

16. A pump mount base for raising and supporting a filter/pump assembly in a fluid handling system above a mounting surface comprising a main body defining a support surface formed as a T shape with a first portion and a second portion wherein the first portion and the second portion are each substantially rectangular in shape and define a first cavity and a second cavity, respectively, and each of the first cavity and second cavity is bordered by cavity walls extending from the support surface to the mounting surface; and one or more shims for placement atop the support surface of the main body, wherein the shims define an upper surface and a lower surface for contacting the upper surface of the main body; and the shims are removably attached to the cavity walls before placement atop the support surface.

17. The pump mount base of claim 16, wherein the first portion has at least one mounting hole for passage of a fastener for securing the pump mount base to the mount surface.

18. The pump mount base of claim 16, wherein the support surface further defines a peripherally positioned, raised lip for positioning the filter/pump assembly.

19. The pump mount base of claim 16, wherein the support surface further defines one or more receptacles for receiving at least one of the shims.

20. The pump mount base of claim 19, wherein each shim includes one or more pins extending from the lower surface of the shim; and the one or more receptacles define one or more apertures for respectively receiving the one or more pins.

* * * * *